US011905965B2

(12) United States Patent
Jennings et al.

(10) Patent No.: US 11,905,965 B2
(45) Date of Patent: Feb. 20, 2024

(54) FAN WHEEL SYSTEMS AND METHODS

(71) Applicant: Air Distribution Technologies IP, LLC, Milwaukee, WI (US)

(72) Inventors: Rickey Wayne Jennings, Sparta, MO (US); Luis Leonardo Vargas, McKinney, TX (US); Arshad Abdul Quader Shaikh, Aurangabad (IN); Anup Tejkumar Kole, Dudhgaon (IN)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 0 days.

(21) Appl. No.: 17/688,642

(22) Filed: Mar. 7, 2022

(65) Prior Publication Data

US 2023/0279866 A1 Sep. 7, 2023

(51) Int. Cl.

| | |
|---|---|
| ***F04D 29/64*** | (2006.01) |
| ***F04D 29/18*** | (2006.01) |
| ***F04D 19/00*** | (2006.01) |

(52) U.S. Cl.

CPC ..... *F04D 29/181* (2013.01); *F04D 19/002* (2013.01); *F04D 29/644* (2013.01)

(58) Field of Classification Search

CPC ..... F04D 29/181; F04D 19/002; F04D 29/644

See application file for complete search history.

(56) References Cited

U.S. PATENT DOCUMENTS

| | | | | |
|---|---|---|---|---|
| 3,368,744 | A * | 2/1968 | Jenn | F04D 29/282 29/889.4 |
| 8,052,386 | B1 * | 11/2011 | Fitzpatrick | F04D 29/30 415/218.1 |
| 8,881,396 | B2 | 11/2014 | Hall et al. | |
| 10,054,132 | B2 | 8/2018 | Kinkel | |
| 10,378,552 | B2 | 8/2019 | Sidle | |
| 10,935,047 | B2 | 3/2021 | Berean | |
| 11,015,451 | B1 | 5/2021 | Karkos | |
| 2017/0058917 | A1 * | 3/2017 | McKinney | F04D 29/384 |
| 2017/0198718 | A1 * | 7/2017 | Yagi | F01D 11/008 |
| 2017/0306777 | A1 * | 10/2017 | Yagi | F04D 29/646 |
| 2018/0156237 | A1 * | 6/2018 | Papin | F01D 9/044 |
| 2020/0173453 | A1 | 6/2020 | Kennedy et al. | |

FOREIGN PATENT DOCUMENTS

| | | |
|---|---|---|
| CN | 103307026 A | 9/2013 |
| KR | 200443960 Y1 | 3/2009 |
| KR | 201009256 U | 9/2010 |

* cited by examiner

*Primary Examiner* — Aaron R Eastman

(74) *Attorney, Agent, or Firm* — Fletcher Yoder, P.C.

(57) ABSTRACT

A fan wheel includes a hub having a passage extending along an axis, where the passage is configured to receive a shaft. The hub includes a first mounting surface positioned at a first location along the axis and a second mounting surface offset from the first mounting surface and positioned at a second location along the axis. The fan wheel also includes a fan blade having a first mounting tab and a second mounting tab, where first mounting tab is configured to engage with and couple to the first mounting surface and the second mounting tab is configured to engage with and couple to the second mounting surface.

20 Claims, 12 Drawing Sheets

FAN WHEEL SYSTEMS AND METHODS

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and air conditioning (HVAC) systems are utilized in residential, commercial, and industrial environments to control environmental properties, such as temperature, humidity, and/or air quality, for occupants of the respective environments. The HVAC system typically includes one or more fans or blowers that are configured to direct air through ductwork of the HVAC system and/or across various components of the HVAC system, such as one or more filters, heat exchangers, and so forth. For example, conventional centrifugal fans are generally designed to intake air along a rotational axis of an impeller of the centrifugal fan and to accelerate the air radially outward from the rotational axis. In contrast, conventional axial fans are generally designed to intake air along a rotational axis of a fan wheel of the axial fan and to accelerate the air axially along the rotational axis. As such, centrifugal fans and axial fans can be used to direct air along suitable flow paths of the HVAC system.

In general, mixed flow fans may utilize features of both centrifugal fans and axial fans to enhance an overall operational efficiency of the mixed flow fans, as well as to reduce audible noise generated during operation of the mixed flow fans. As such, mixed flow fans may provide certain benefits over centrifugal fans and/or axial fans. Unfortunately, fan wheels of the mixed flow fans may be arduous, costly, and time consuming to manufacture.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a fan wheel. The fan wheel includes a hub having a passage extending along an axis and configured to receive a shaft. The hub includes a first mounting surface positioned at a first location along the axis and a second mounting surface offset from the first mounting surface and positioned at a second location along the axis. The fan wheel also includes a fan blade having a first mounting tab and a second mounting tab, where first mounting tab is configured to engage with and couple to the first mounting surface and the second mounting tab is configured to engage with and couple to the second mounting surface.

The present disclosure also relates to a fan wheel that includes a hub having a passage extending along an axis and configured to receive a shaft. The fan wheel also includes a shroud disposed about the hub. The shroud includes an inner surface, where the inner surface extends from a first end portion of the shroud to a second end portion of the shroud, and the inner surface diverges radially from the axis along a direction extending from the first end portion toward the second end portion. The fan wheel also includes a fan blade having a body portion and a plurality of mounting tabs extending from the body portion, where the plurality of mounting tabs is coupled to the inner surface via mechanical fasteners.

The present disclosure also relates to a fan wheel for a mixed flow fan system. The fan wheel includes a hub configured to rotate about an axis of the mixed flow fan system. The hub includes a first hub plate having a first mounting surface positioned at a first location along the axis and a second hub plate offset from the first hub plate along the axis. The second hub plate includes a second mounting surface positioned at a second location along the axis. The fan wheel also includes a fan blade having a first mounting tab and a second mounting tab, where the first mounting tab is mounted to the first mounting surface, and the second mounting tab is mounted to the second mounting surface.

BRIEF DESCRIPTION OF THE DRAWINGS

Various aspects of this disclosure may be better understood upon reading the following detailed description and upon reference to the drawings in which.

DETAILED DESCRIPTION

Figure 1:
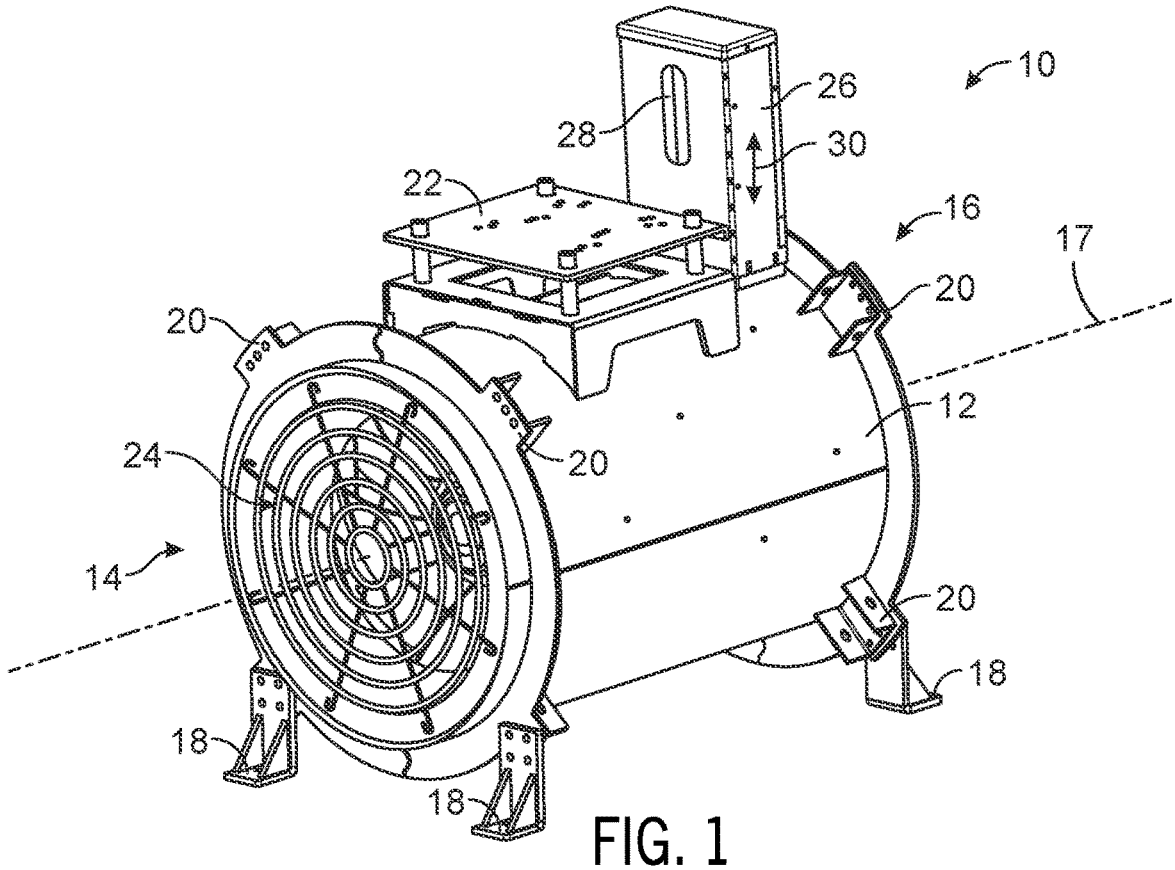
FIG. 1 is a front perspective view of an embodiment of a mixed flow fan system, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to mean that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Mathematical terms, such as parallel, perpendicular, and planar, should not be rigidly interpreted in a mathematical sense, but as one of ordinary skill in the art would interpret such terms. For example, one of ordinary skill in the art would understand that two lines that are substantially parallel to each other are parallel to a substantial degree, with only minor deviation from parallel.

As briefly discussed above, a heating, ventilation, and/or air conditioning (HVAC) system may be used to thermally regulate a space within a building, home, or other suitable structure. For example, the HVAC system may include a vapor compression system that transfers thermal energy between a working fluid, such as a refrigerant, and a fluid to be conditioned, such as air. The vapor compression system includes heat exchangers, such as a condenser and an evaporator, which are fluidly coupled to one another via one or more conduits of a refrigerant loop or circuit. A compressor may be used to circulate the refrigerant through the conduits and other components of the refrigerant circuit (e.g., an expansion device) and, thus, enable the transfer of thermal energy between components of the refrigerant circuit (e.g., between the condenser and the evaporator) and one or more thermal loads (e.g., an environmental air flow, a supply air flow). Additionally or alternatively, the HVAC system may include a heat pump having a first heat exchanger (e.g., a heating and/or cooling coil), a second heat exchanger (e.g., a heating and/or cooling coil), and a pump configured to circulate a working fluid (e.g., water, brine, refrigerant) between the first and second heat exchangers to enable heat transfer between the thermal loads and an ambient environment (e.g., the atmosphere), for example. Further, the HVAC system may be utilized to facilitate filtration of air (e.g. by directing an air flow across one or more filter assemblies) with or without heating or cooling the air flow.

Indeed, it should be understood that, as used herein, an HVAC system includes any number of components configured to enable regulation of parameters related to climate characteristics, such as temperature, humidity, air flow, pressure, air quality, and so forth. For example, an "HVAC system" may be defined as conventionally understood and as further described herein. Components or parts of an HVAC system may include, but are not limited to, all, some of, or individual parts, such as a heat exchanger, a heater, an air flow control device, such as a fan or blower, a sensor configured to detect a climate characteristic or operating parameter, a filter, a control device configured to regulate operation of an HVAC system component, a component configured to enable regulation of climate characteristics, or a combination thereof. An HVAC system is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

The present disclosure is directed to a mixed flow fan system (e.g., an inline mixed flow fan, an inline centrifugal mixed flow fan) that includes a high efficiency mixed flow fan wheel configured to direct air along an air flow path of an HVAC system (e.g., an HVAC unit, ductwork, etc.). As such, the mixed flow fan system may be suitable for supply, exhaust, and/or return air applications, for example. The compact and lightweight design of the mixed flow fan system described herein combines the relatively higher air moving capabilities of axial fan systems with the relatively lower sound output and relatively higher operating efficiency of centrifugal fan systems. Thus, embodiments of the mixed flow fan system described herein may surpass the efficiency of conventional centrifugal fan systems and axial fan systems.

It is presently recognized that manufacture of a mixed flow fan wheel may be arduous, time consuming, and infeasible in certain circumstances. Indeed, conventional techniques for manufacturing a mixed flow pan wheel typically include welding multiple individual fan components into a unitary structure to form the mixed flow fan wheel. For example, to enable bonding of fan components of the mixed flow fan wheel via a metallurgical process (e.g., welding), the fan components may typically have a relatively large material thickness. Unfortunately, increasing a material thickness of the fan components used to manufacture the mixed flow fan wheel may increase costs associated with producing the mixed flow fan wheel. Moreover, mixed flow fan wheels assembled from fan components having a relatively large material thickness may have a relatively high overall mass, thereby increasing an inertial force that may be associated with accelerating, decelerating, and/or maintaining a speed of the mixed flow fan wheels during operation of the mixed flow fans. Still further, it may be difficult to appropriately align fan components of conventional mixed flow fan wheels during manufacture of the mixed flow fan wheels, prior to bonding of the fan components via a metallurgical process, which may increase the time and complexity involved with assembling the mixed flow fan wheels. As such, design and construction of traditional mixed flow fan wheels have various drawbacks, and overall operational efficiencies of conventional mixed flow fans may be limited.

Accordingly, embodiments of the present disclosure are directed toward an improved mixed flow fan wheel that overcomes the shortcomings of traditional mixed flow fan wheels. As discussed in detail herein, the mixed flow fan wheel of the present disclosure includes a plurality of fan components that may be coupleable (e.g., to one another) via mechanical interlocking features (e.g., mechanical fasteners, such as rivets, screws, friction pins, etc.) to reduce or eliminate usage of welding or another metallurgical bonding process during manufacture of the mixed flow fan wheel. By enabling assembly of the mixed flow fan wheel without or substantially without metallurgical bonding processes (e.g., welding), a material thickness of the individual fan components utilized in the mixed flow fan wheel may be reduced. As a result, the assembled mixed flow fan wheel may have a reduced mass, as compared to typical mixed flow fan wheels, which may permit higher relative operational efficiencies of a mixed flow fan system utilizing the mixed flow fan wheel discussed herein. Moreover, the mixed flow fan wheel of the present disclosure may include alignment features that facilitate alignment of individual fan components of the mixed flow fan wheel during manufacture (e.g., assembly) of the mixed flow fan wheel. To this end, an assembly time and/or costs associated with producing the mixed flow fan wheel may be reduced. These and other features will be described in detail below with reference to the drawings.

Figure 2:
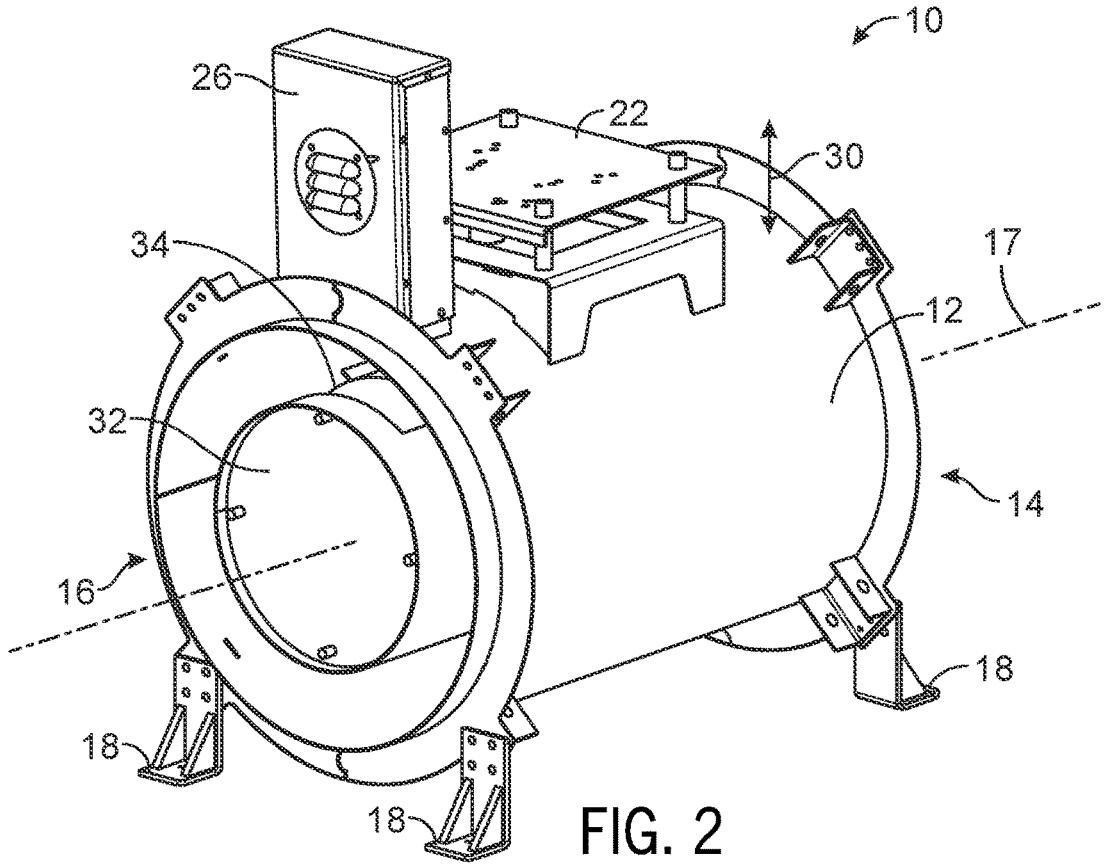
FIG. 2 is a rear perspective view of an embodiment of a mixed flow fan system, in accordance with an aspect of the present disclosure.

Turning now to the drawings, FIG. 1 is a front perspective view of an embodiment of a mixed flow fan system 10, also referred to herein as an inline mixed flow fan system and/or an inline centrifugal mixed flow fan system. FIG. 2 is a rear perspective view of an embodiment of the mixed flow fan system 10. FIGS. 1 and 2 are discussed concurrently below. In certain embodiments, the mixed flow fan system 10 includes a housing 12 (e.g., a generally cylindrical housing) having an inlet end 14 configured to intake air from a surrounding environment and a discharge end 16 configured to discharge air from the housing 12. As used herein, the terms "inlet end," "inlet side," "upstream end," "upstream side," "upstream end portion," and so forth, are intended to describe ends and sides of components that are closer to the inlet end 14 of the mixed flow fan system 10 (e.g., along a longitudinal axis 17 of the mixed flow fan system 10), whereas the terms "discharge end," "discharge side," "downstream end," "downstream side," "downstream end portion," and so forth, are intended to describe ends and sides of components that are closer to the discharge end 16 of the mixed flow fan system 10 (e.g., along the longitudinal axis 17 of the mixed flow fan system 10).

As illustrated in FIGS. 1 and 2, in certain embodiments, the mixed flow fan system 10 includes a plurality of mounting features, such as mounting feet 18 (e.g., bolted mounting feet) and mounting rails 20, which facilitate securement of the mixed flow fan system 10 to external structures (e.g., support rails of an HVAC unit having the mixed flow fan system 10). As also illustrated, in some embodiments, the mixed flow fan system 10 may include a motor mounting base 22 (e.g., an adjustable motor mounting base) to which a motor, such as an electric motor, may be mounted. As described in greater detail herein, the motor may be configured to rotate a fan wheel 24 (e.g., a mixed flow fan wheel, a fan wheel assembly) disposed within the housing 12 of the mixed flow fan system 10. Rotation of the fan wheel 24 about the longitudinal axis 17 may induce air to flow through the mixed flow fan system 10. For clarity, it should thus be understood that the longitudinal axis 17 may also correspond to a rotational axis of the fan wheel 24.

In some embodiments, the mixed flow fan system 10 includes a belt tunnel 26 within which a drive belt may be disposed. The drive belt is physically coupled to an output shaft of the motor of the mixed flow fan system 10 and to a shaft (e.g., a drive shaft) disposed within the housing 12 and coupled to the fan wheel 24. In this way, the drive belt facilitates transfer of power from the motor of the mixed flow fan system 10 to the drive shaft of the mixed flow fan system 10 and, therefore, to the fan wheel 24. Accordingly, the motor of the mixed flow fan system 10 may drive rotation of the fan wheel 24 and cause the fan wheel 24 to force air through the housing 12.

In certain embodiments, the belt tunnel 26 may include an elongated motor output shaft opening 28 through which an output shaft of the motor of the mixed flow fan system 10 may extend. The output shaft may physically couple to the drive belt within the belt tunnel 26. In certain embodiments, a distance by which the motor mounting base 22 extends from the housing 12 of the fan system 10 may be adjustable, as illustrated by arrow 30, and the elongated shape of the motor output shaft opening 28 accommodates adjustable positioning of the motor mounting base 22 (and thus the output shaft of the motor) relative to the housing 12. As also illustrated in FIG. 2, in some embodiments, the mixed flow fan system 10 may include a bearing tunnel 32 within which bearings that support the drive shaft of the fan wheel 24 may be disposed. The bearing tunnel 32 may include a belt drive opening 34 through which the belt drive that is physically coupled to both the output shaft of the motor and the drive shaft coupled to the fan wheel 24 may extend.

Figure 3:
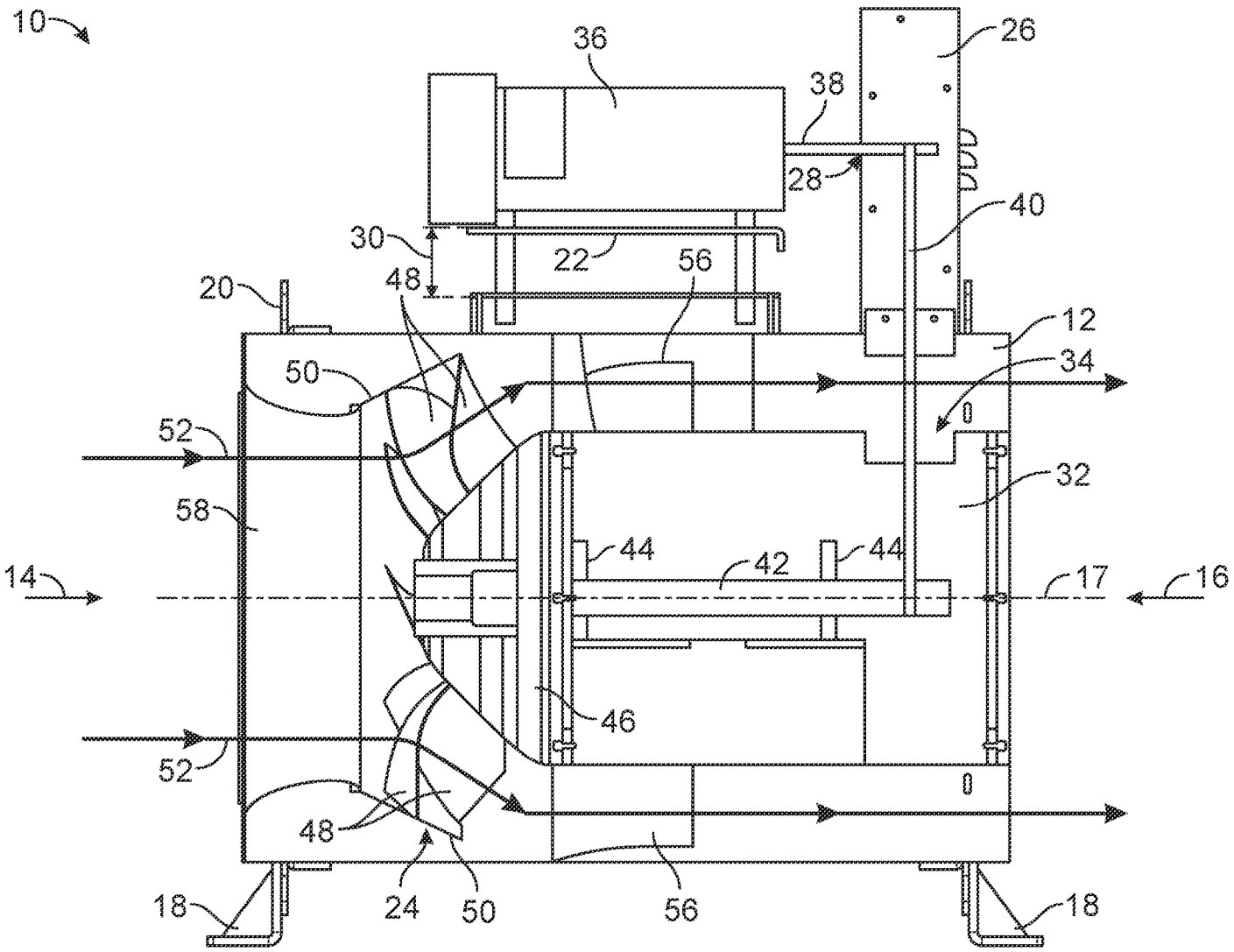
FIG. 3 is a partial cross-sectional view of an embodiment of a mixed flow fan system, in accordance with an aspect of the present disclosure.

FIG. 3 is a partial cross-sectional view of an embodiment of the mixed flow fan system 10. As shown in the illustrated embodiment of FIG. 3, a motor 36 of the mixed flow fan system 10 may be physically coupled (e.g., mounted, attached) to the motor mounting base 22 (e.g., via suitable fasteners). An output shaft 38 of the motor 36 may extend into the motor output shaft opening 28 of the belt tunnel 26. The output shaft 38 may be physically coupled to a drive belt 40 that is also physically coupled to a drive shaft 42 disposed within the bearing tunnel 32. As such, the motor 36 may drive rotation of the drive shaft 42 and the fan wheel 24 coupled to the drive shaft 42 via engagement between the output shaft 38 of the motor 36, the drive belt 40, and the drive shaft 42. As also illustrated in FIG. 3, one or more bearings 44 may be disposed within the bearing tunnel 32 of the mixed flow fan system 10 and may support the drive shaft 42.

In some embodiments, the fan wheel 24 includes a hub 46, a plurality of fan blades 48 coupled to and extending from the hub 46, and a shroud 50 that may at least partially radially and/or circumferentially surround the plurality of fan blades 48. As discussed below, each of the plurality of fan blades 48 may be physically connected, such as via mechanical fasteners (e.g., rivets, screws, spring pins, or a combination thereof), to both the hub 46 and the shroud 50. As such, the hub 46, the plurality of fan blades 48, and the shroud 50 may collectively form the fan wheel 24 and may rotate in unison with each other (e.g., about the longitudinal axis 17). More specifically, rotational motion of the drive shaft 42 is transferred to the fan wheel 24, which causes the hub 46, the plurality of fan blades 48, and the shroud 50 to rotate in unison and draw an air flow 52 into the housing 12 via the inlet end 14 of the mixed flow fan system 10 (e.g., generally parallel to and/or along the longitudinal axis 17). Rotation of the fan wheel 24 also enables pressurization of the air flow 52 and acceleration of the air flow 52 radially outward with respect to the longitudinal axis 17 and axially along the longitudinal axis 17 (e.g., toward the discharge end 14). As the air flow is forced through the housing 12, the air flow 52 may be directed across a plurality of guide vanes 56 to generally "straighten" the air flow 52 (e.g., along the longitudinal axis 17). That is, the guide vanes 56 may generally counteract radial and circumferential movement of the air flow 52 to cause the air flow 52 to travel substantially axially (e.g., along the longitudinal axis 17) and out of the housing 12 via the discharge end 16 of the mixed flow fan system 10. In some embodiments, an inlet venturi 58 is disposed at the inlet end 14 of the mixed flow fan system 10 to funnel the air flow 52 into the fan wheel 24 during operation of the mixed flow fan system 10. In certain embodiments, the inlet venturi 58 is fixedly coupled to the housing 12 of the mixed flow fan system 10 such that the inlet venturi 58 remains in a fixed position. The fan wheel 24 is disposed adjacent the inlet venturi 58 and rotates about the longitudinal axis 17 relative to the inlet venturi 58.

In the manner described above, the mixed flow fan system 10 generally combines features of centrifugal fan systems and axial fan systems to generate an air flow (e.g., the air flow 52) having beneficial characteristics of air flows generated by both centrifugal fan systems and axial fan systems. For example, centrifugal fan systems are generally used to intake air parallel to a central longitudinal axis of a fan and to accelerate the air radially outward from or generally transverse to a rotational axis of an impeller of the fan. In contrast, axial fan systems are used to intake air parallel to a rotational axis of a fan and to accelerate the air axially along the rotational axis. The mixed flow fan system 10 described herein combines certain features of both centrifugal fan systems and axial fan systems to enable acceleration of the air flow 52 radially, axially, and circumferentially (e.g., with respect to the longitudinal axis 17) using the fan wheel 24 and to also enable straightening of the air flow 52 downstream of the fan wheel 24 using the plurality of guide vanes 56. As such, the fan wheel 24 and the plurality of guide vanes 56 function together to provide the air flow 52 that flows in radial, axial, and circumferential directions to generate a mixed air flow that is "straightened" to exit the mixed flow fan system 10 generally axially. Hence, the disclosed mixed flow fan system 10 may be described as an inline centrifugal mixed flow fan system. By combining aspects of both centrifugal fan systems and axial fan systems, the mixed flow fan system 10 provides certain benefits of both centrifugal fan systems and axial fan systems, such as exceptionally efficient air movement, higher static pressures, relatively low ambient noise, and a relatively steep fan curve.

Figure 4:
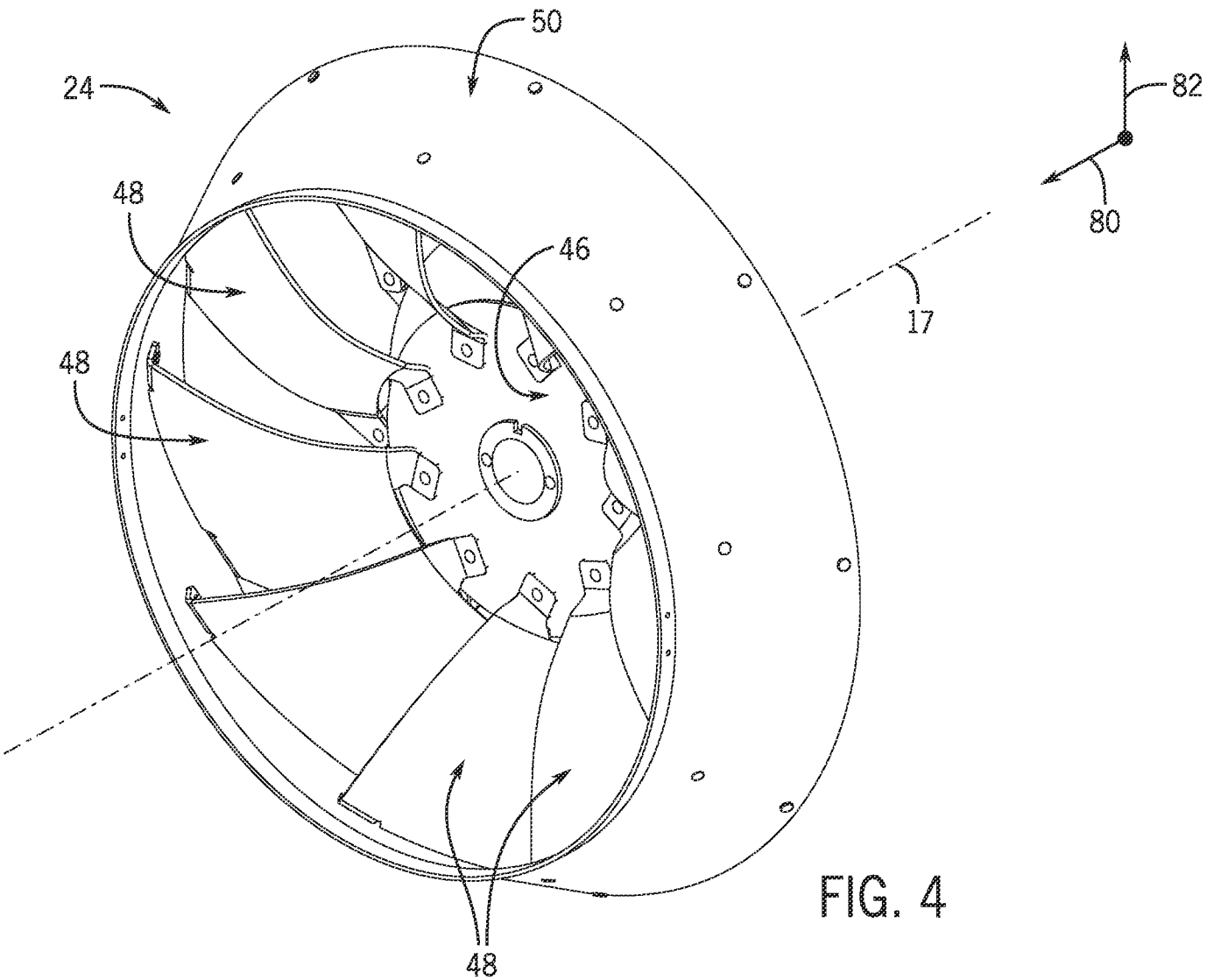
FIG. 4 is a perspective view of an embodiment of a fan wheel of a mixed flow fan system, in accordance with an aspect of the present disclosure.

FIG. 4 is a perspective view of an embodiment of the fan wheel 24. To facilitate the following discussion, the fan wheel 24 may be described with respect to an axial axis 80 (e.g., a longitudinal axis, a first axis) and a radial axis 82 (e.g., a second axis), which extends generally orthogonal to or cross-wise from the axial axis 80. The axial axis 80 may be aligned with the longitudinal axis 17 such that, during operation of the fan wheel 24, the fan wheel 24 may rotate about the axial axis 80. The fan wheel 24 includes the hub 46 (e.g., a hub assembly) and the shroud 50 that is disposed (e.g., radially and/or circumferentially) about the hub 46. As discussed in detail herein, the fan wheel 24 includes the plurality of fan blades 48 that extend (e.g., radially) between the hub 46 and the shroud 50. As such, the hub 46, the shroud 50, and the fan blades 48 may collectively form the fan wheel 24. The components of the fan wheel 24 are discussed in detail below.

Figure 5:
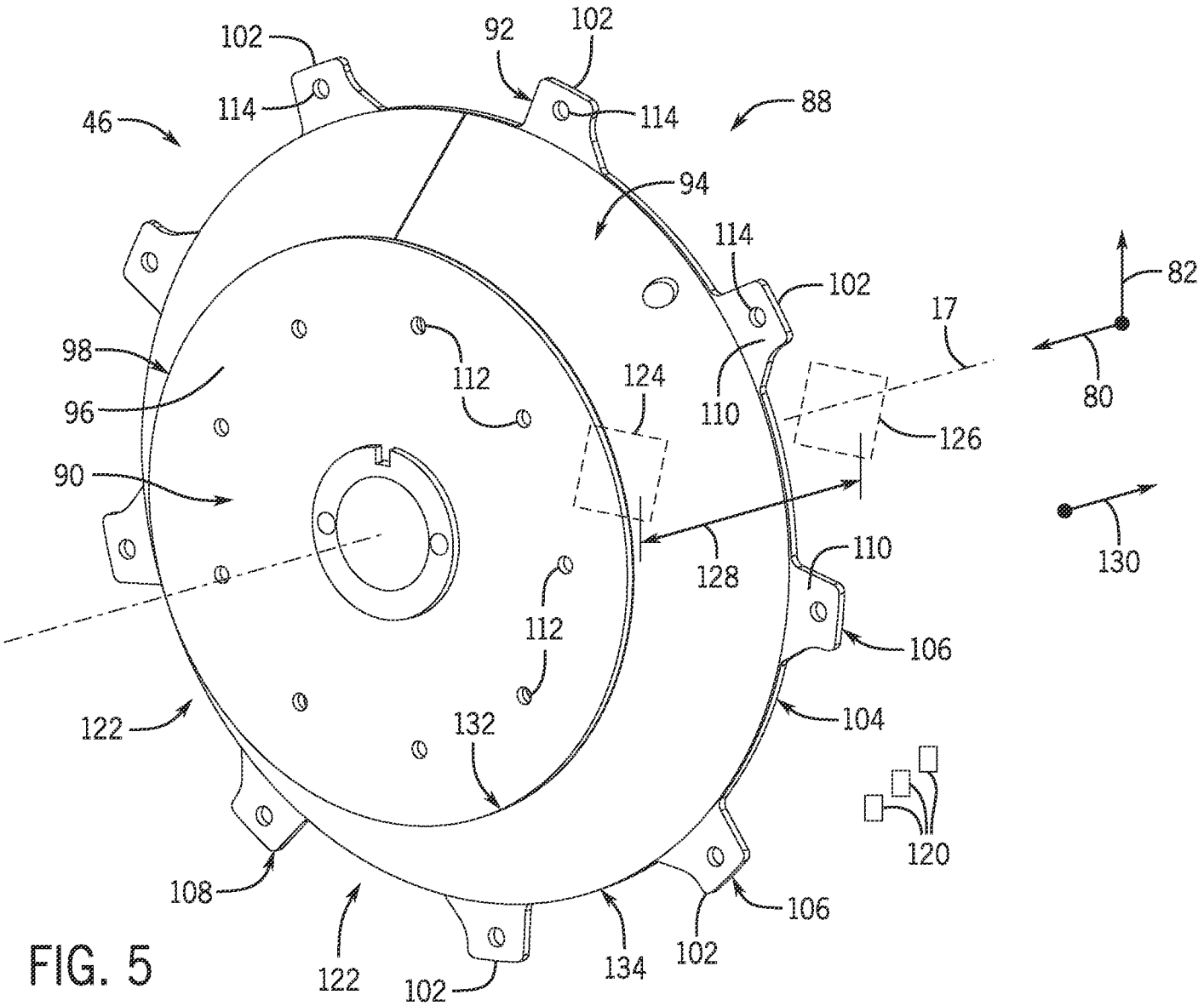
FIG. 5 is a perspective view of an embodiment of a hub of a mixed flow fan system, in accordance with an aspect of the present disclosure.

FIG. 5 is a perspective view of an embodiment of the hub 46 of the fan wheel 24, illustrating the hub 46 in an assembled configuration 88. The hub 46 includes a first hub plate 90, a second hub plate 92 (FIG. 6), and a web 94 (e.g., a wrap) extending from the first hub plate 90 to the second hub plate 92. The first hub plate 90 may include a first mounting surface 96 and may have a first perimeter 98 (e.g., circumference). In certain embodiments, the first perimeter 98 may form a generally circular outer profile of the first hub plate 90. The second hub plate 92 may include a body portion 100 (FIG. 6) and a plurality of tabs 102 (e.g., extensions, mounting flanges, etc.) extending (e.g., radially) from the body portion 100. A first outer edge 104 of the body portion 100 and second outer edges 106 of the tabs 102 may collectively define a second perimeter 108 of the second hub plate 92. The tabs 102 may form at least a portion of a second mounting surface 110 of the second hub plate 92. As discussed below, the fan blades 48 may be configured to engage with and couple to (e.g., attach to) the first mounting surface 96 of the first hub plate 90 and the second mounting surface 110 of the second hub plate 92 to facilitate mounting of the fan blades 48 to the hub 46.

In some embodiments, the first hub plate 90 includes a plurality of first mounting apertures 112 formed therein, and the second hub plate 92 includes a plurality of second mounting apertures 114 formed therein. For example, in certain embodiments, each of the tabs 102 may include a corresponding one of the second mounting apertures 114 formed therein. As discussed below, the first and second mounting apertures 112, 114 may facilitate coupling of the fan blades 48 to the hub 46 using fasteners 120 (e.g., mechanical fasteners, such as rivets, screws, spring pins, bolts, etc.). In particular, the first and second mounting apertures 112, 114 may facilitate coupling of the fan blades 48 to the hub 46 without using a metallurgical process, such as welding or brazing. It should be appreciated that, in certain embodiments, the body portion 100 of the second hub plate 92 may extend to fill voids 122 between the tabs 102, such that the second perimeter 108 of the second hub plate 92 may include an outer profile that is generally circular, for example.

In some embodiments, the first mounting surface 96 may be aligned with and extend along a first plane 124, and the second mounting surface 110 may be aligned with and extend along a second plane 126. The axial axis 80 may extend through the first plane 124 and the second plane 126 and may extend generally orthogonally (e.g., perpendicularly, cross-wise) to the first plane 124 and the second plane 126. The radial axis 82 may extend generally parallel to the first plane 124 and the second plane 126. The first plane 124 may be offset from the second plane 126 by an offset dimension 128 that extends along (e.g., substantially parallel to) the axial axis 80. As such, it should be understood that the first mounting surface 96 may extend generally parallel to the second mounting surface 110 and that the first mounting surface 96 may be offset from the second mounting surface 110 by the offset dimension 128. That is, the first mounting surface 96 may be positioned at a first location along the axial axis 80, and the second mounting surface 110 may be positioned at a second, different location along the axial axis 80.

As shown in FIG. 5, the web 94 extends from the first perimeter 98 of the first hub plate 90 to the first outer edge 104 of the body portion 100 of the second hub plate 92. In some embodiments, the body portion 100 of the second hub plate 92 may extend radially beyond (e.g., with respect to the axial axis 80) the first perimeter 98 of the first hub plate 90. As such, the web 94 may diverge radially from the axial axis 80 along a first direction 130 (e.g., a direction along the axial axis 80) extending form the first mounting surface 96 toward the second mounting surface 110. That is, a radial dimension of the web 94 (e.g., with respect to the axial axis 80) may increase from a first end portion 132 of the web 94 positioned near the first hub plate 90 toward a second end portion 134 of the web 94 positioned near the second hub plate 92. In some embodiments, the radial dimension of the web 94 may increase uniformly from the first end portion 132 to the second end portion 134 of the web 94. In other embodiments, the web 94 may include a variable (e.g., curved) cross-sectional profile, and the radial dimension of the web 94 may increase non-uniformly from the first end portion 132 to the second end portion 134 of the web 94.

In some embodiments, the web 94 may be coupled to the first hub plate 90 and the second hub plate 92 via additional fasteners (e.g., mechanical fasteners). For example, the first hub plate 90, the second hub plate 92, the web 94, or a combination thereof, may include mounting flanges and/or apertures that facilitate coupling of the first hub plate 90, the second hub plate 92, and the web 94 via the fasteners. In other embodiments, the first hub plate 90, the second hub plate 92, and the web 94 may be coupled to one another via another suitable technique. During operation of the mixed flow fan system 10, the first hub plate 90 may be positioned upstream of the second hub plate 92 with respect to a direction of the air flow 52 across the fan wheel 24. Throughout the following discussion, the first mounting surface 96 may also be referred to as an upstream mounting surface of the hub 46, and the second mounting surface 110 may also be referred to as a downstream mounting surface of the hub 46.

Figure 6:
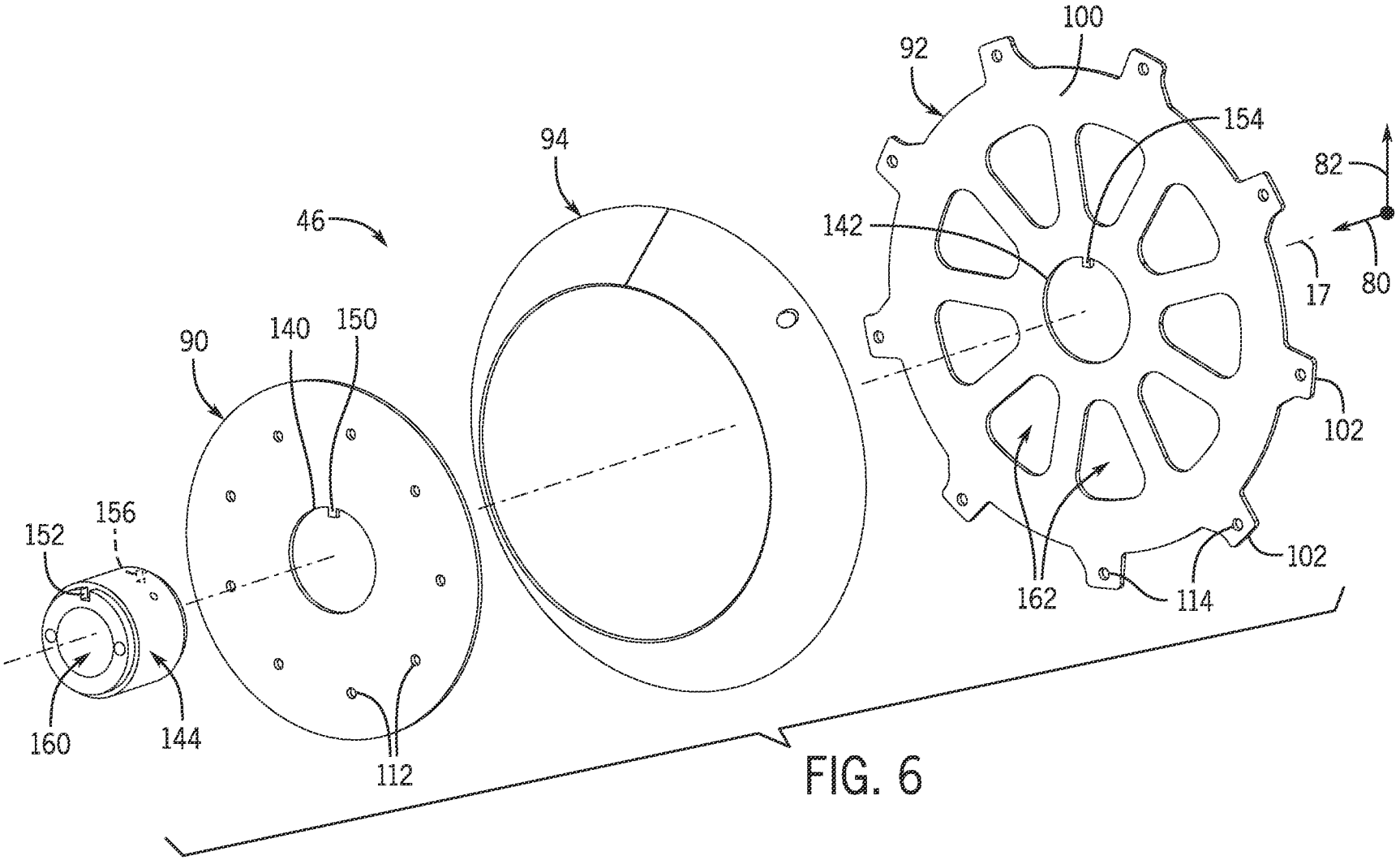
FIG. 6 is an exploded perspective view of an embodiment of a hub of a mixed flow fan system, in accordance with an aspect of the present disclosure.

The following discussion continues with concurrent reference to FIG. 5 and FIG. 6, which is an exploded perspective view of an embodiment of the hub 46. In some embodiments, the first hub plate 90 includes a first opening 140 formed therein, and the second hub plate 92 includes a second opening 142 formed therein. The first opening 140 and the second opening 142 may be configured to receive a collar 144 of the hub 46. In particular, the collar 144 may be received by an inner perimeter of the first opening 140 and an inner perimeter of the second opening 142. In certain embodiments, the first hub plate 90 may include a first protrusion 150 extending therefrom (e.g., into the first opening 140, toward the axial axis 80). The first protrusion 150 may be configured to engage with a first slot 152 of the collar 144 in the assembled configuration 88 of the hub 46. Similarly, the second hub plate 92 may include a second protrusion 154 extending therefrom (e.g., into the second opening 142, toward the axial axis 80), and the second protrusion 154 may be configured to engage with a second slot 156 of the collar 144 in the assembled configuration 88 of the hub 46. Engagement between the protrusions 150, 154 and the corresponding slots 152, 156 may block rotational motion (e.g. about the axial axis 80) of the collar 144 relative to the first hub plate 90 and the second hub plate 92 in the assembled configuration 88 of the hub 46 and during operation of the mixed flow fan system 10. The collar 144 may define a passage 160 that is configured to interface and engage with the drive shaft 42 to facilitate power transfer (e.g., transfer of rotational motion) from the motor 36 to the fan wheel 24 in accordance with the aforementioned techniques. Thus, the passage 160 may extend along the axial axis 80.

In some embodiments, the second hub plate 92 may include a plurality of cutouts 162 (e.g., openings, apertures, etc.) formed therein. The cutouts 162 may be arrayed in a uniform or non-uniform manner about the second opening 142 (e.g., circumferentially about the axial axis 80). The cutouts 162 may enable a reduction in an overall amount of material utilized to produce the second hub plate 92. As such, the cutouts 162 may reduce manufacturing costs associated with producing the fan wheel 24, for example. Moreover, the cutouts 162 may reduce a weight of the second hub plate 92 and, thus, reduce an overall rotational inertia (e.g., relative to the axial axis 80) of the fan wheel 24. In this way, the cutouts 162 may reduce an amount of power consumed by the motor 36 to adjust an operational speed of the fan wheel 24 during operation of the mixed flow fan system 10. As a result, an overall operational efficiency of the mixed flow fan system 10 may be improved. In some embodiments, the first hub plate 90 may include one or more cutouts similar to the cutouts 162 formed in the second hub plate 92. In other embodiments, the cutouts 162 may be omitted from the second hub plate 92.

Figure 7:
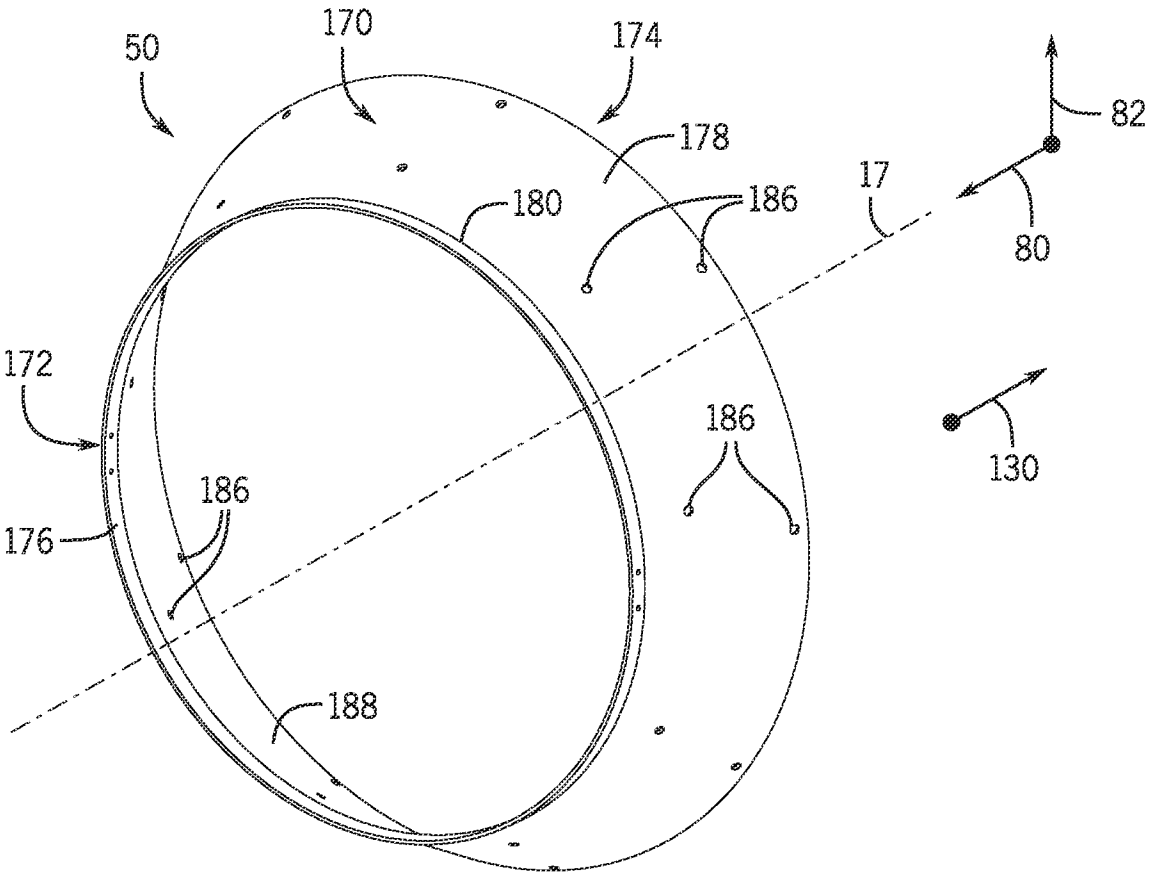
FIG. 7 is a perspective view of an embodiment of a shroud of a mixed flow fan system, in accordance with an aspect of the present disclosure.

FIG. 7 is a perspective view of an embodiment of the shroud 50 of the fan wheel 24. The shroud 50 includes a body 170 that extends from an upstream end portion 172 of the shroud 50 to a downstream end portion 174 of the shroud 50. For clarity, during operation of the mixed flow fan system 10, the upstream end portion 172 may be positioned upstream of the downstream end portion 174 with respect to a direction of the air flow 52 across the fan wheel 24. The body 170 of the shroud 50 includes a first section 176 and a second section 178 that extends from the first section 176 at an interface 180 (e.g., junction). In some embodiments, the first section 176 may include a substantially constant radial dimension (e.g., with respect to the axial axis 80) to form a generally cylindrical section of the shroud 50. A radial dimension of the second section 178 may increase along the first direction 130 such that the second section 178 of the shroud 50 expands (e.g., expands along radial axis 82) from the upstream end portion 172 toward the downstream end portion 174. That is, a radial dimension of the shroud 50 at the interface 180 between the first section 176 and the second section 178 may be less than a radial dimension of the second section 178 at the downstream end portion 174 of the shroud 50. In some embodiments, the radial dimension of the second section 178 may increase uniformly from the interface 180 toward the downstream end portion 174 of the shroud 50. In other embodiments, the second section 178 may include a variable (e.g., curved) cross-sectional profile such that the radial dimension of the second section 178 increases non-uniformly from the interface 180 to the downstream end portion 174 of the shroud 50. Moreover, in certain embodiments, the first section 176 may be omitted from the shroud 50, and the interface 180 may form the upstream end portion 172 of the shroud 50.

In some embodiments, the shroud 50 includes plurality of third mounting apertures 186 formed therein (e.g., formed in the second section 178) that, as discussed in detail below, facilitate coupling of the fan blades 48 to the shroud 50 (e.g., via mechanical fasteners). In particular, the third mounting apertures 186 may facilitate coupling of the fan blades 48 to an inner surface 188 of the shroud 50 (e.g., an inner surface of the second section 178) using the fasteners 120 (e.g., mechanical fasteners, such as rivets, screws, friction pins, etc.), for example. That is, the third mounting apertures 186 may facilitate coupling of the fan blades 48 to the shroud 50 without using a metallurgical process, such as welding or brazing.

Figure 8:
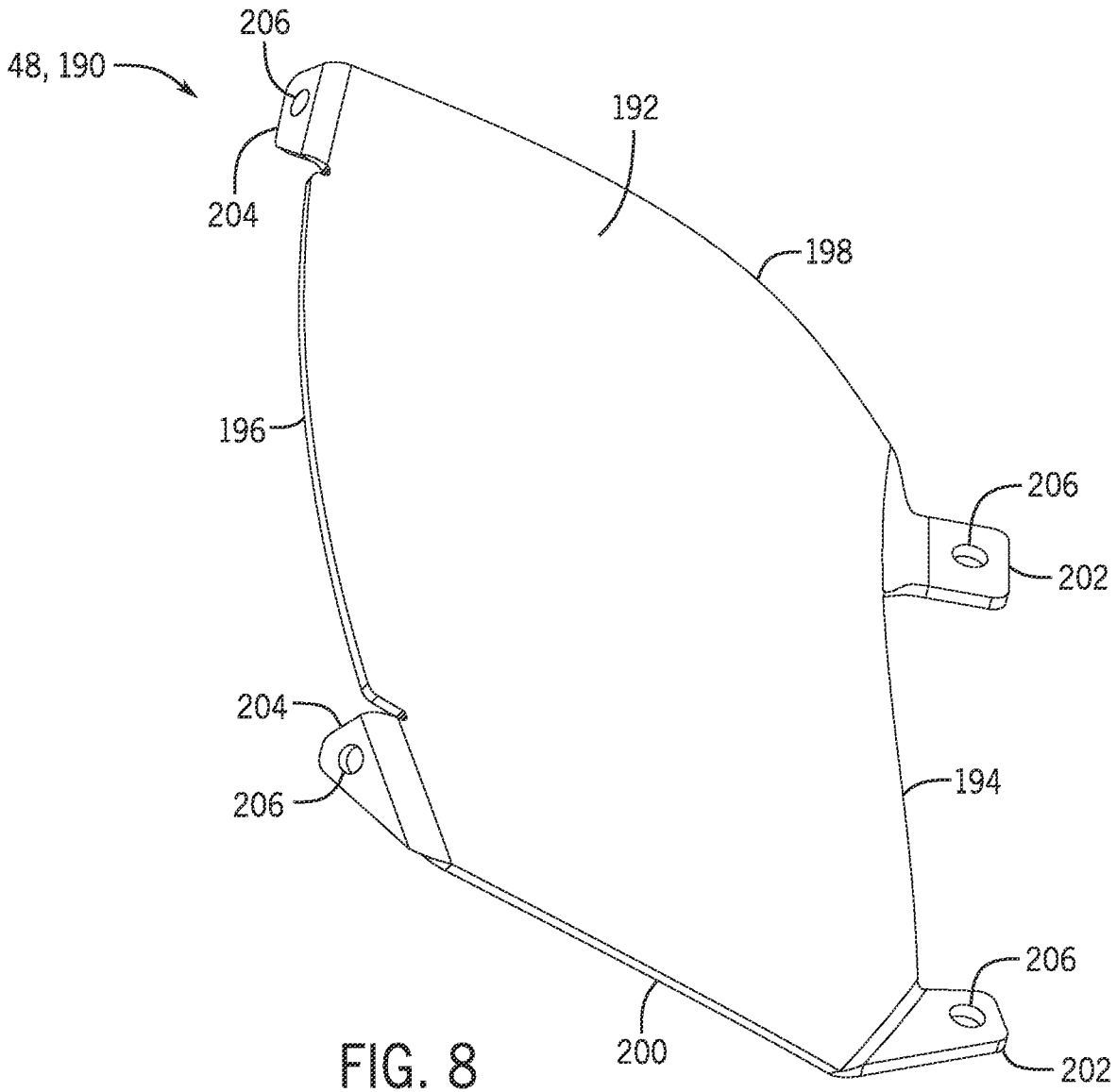
FIG. 8 is a perspective view of an embodiment of a fan blade of a mixed flow fan system, in accordance with an aspect of the present disclosure.

FIG. 8 is a perspective view of an embodiment of a fan blade of the plurality of fan blades 48, referred to herein as a fan blade 190. In some embodiments, each of the fan blades 48 may include the features of the fan blade 190 discussed herein. In the illustrated embodiment, the fan blade 190 includes body piece 192 (e.g., a body portion, a main body) that may be defined by a first edge 194, a second edge 196, a third edge 198, and a fourth edge 200. In an installed configuration of the fan blade 190 with the hub 46 and the shroud 50, the first edge 194 may form a radially inner edge (e.g., with respect to the axial axis 80) of the fan blade 190, and the second edge 196 may form a radially outer edge (e.g., with respect to the axial axis 80) of the fan blade 190. In other embodiments, the fan blade 190 may be coupled to the hub 46 and the shroud 50 in another suitable orientation.

In certain embodiments, the fan blade 190 includes a plurality of first mounting tabs 202 (e.g., mounting flanges) that facilitate coupling and securement of the fan blade 190 to the hub 46 and a plurality of second mounting tabs 204 (e.g., mounting flanges) that facilitate coupling and securement of the fan blade 190 to the shroud 50. The first mounting tabs 202 may extend from the body piece 192 of the fan blade 190 at or near the first edge 194, and the second mounting tabs 204 may extend from the body piece 192 of the fan blade 190 at or near the second edge 196. The first and second mounting tabs 202, 204 may each include a corresponding aperture 206 formed therein. As discussed below, the apertures 206 may be configured to receive the fasteners 120 to facilitate coupling of the fan blade 190 to the hub 46 and the shroud 50. Moreover, the apertures 206 may facilitate proper alignment between the hub 46, the fan blades 48, and the shroud 50 during manufacture and assembly of the fan wheel 24. Although the illustrated embodiment of the fan blade 190 includes two of the first mounting tabs 202 and two of the second mounting tabs 204, in other embodiments, the fan blade 190 may include any suitable quantity of first mounting tabs 202 and/or second mounting tabs 204. For example, the fan blade 190 may include two of the first mounting tabs 202 and a single second mounting tab 204.

Figure 9:
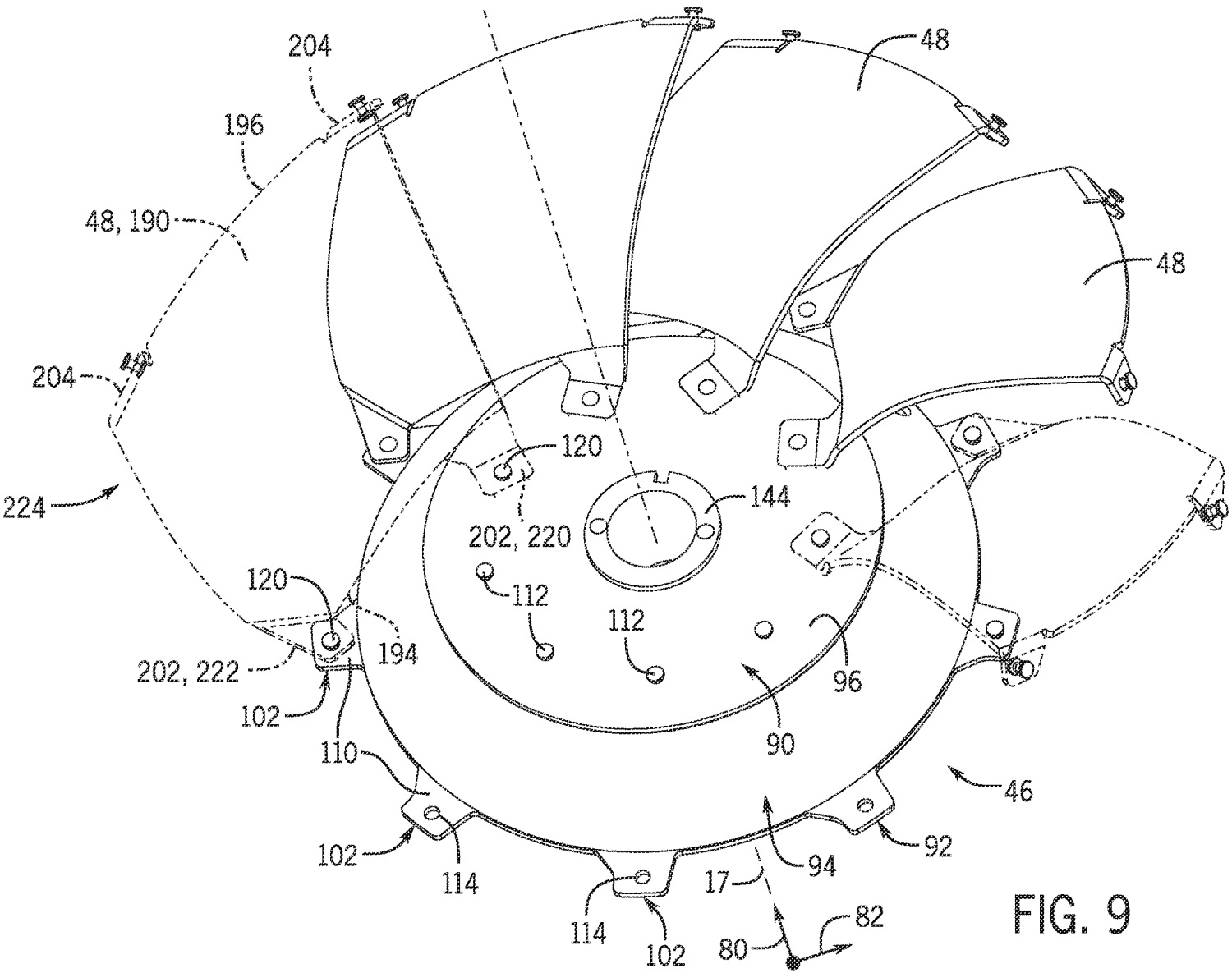
FIG. 9 is a perspective view of an embodiment of a hub and fan blades of a mixed flow fan system, in accordance with an aspect of the present disclosure.
Figure 10:
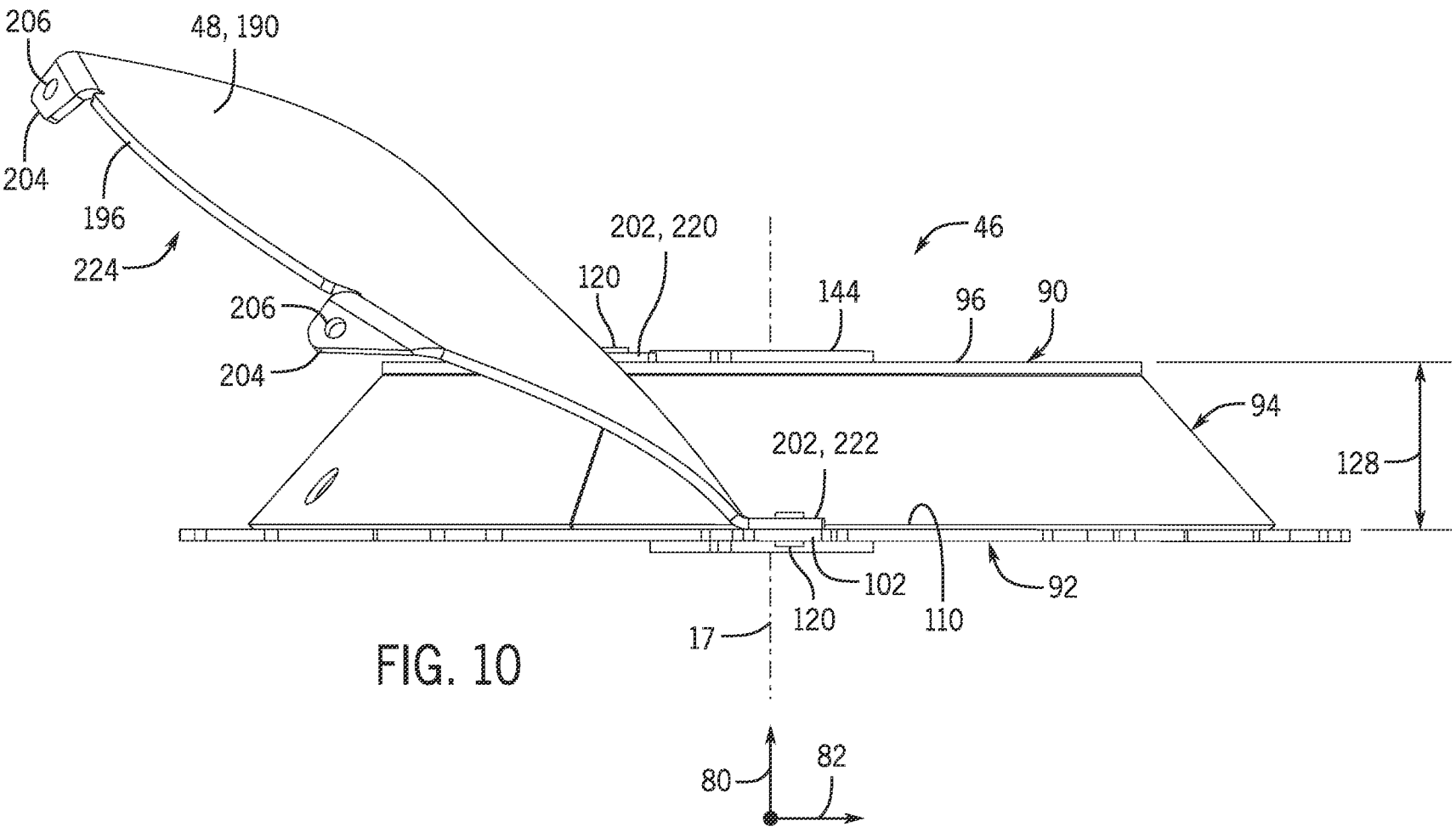
FIG. 10 is an elevation view of an embodiment of a hub and a fan blade of a mixed flow fan system, in accordance with an aspect of the present disclosure.

FIG. 9 is a perspective view of an embodiment of a portion of the fan wheel 24 that includes the hub 46 and a subset of the fan blades 48. FIG. 10 is an elevation view of an embodiment of a portion of the fan wheel 24 that includes the hub 46 and the fan blade 190. FIGS. 9 and 10 are discussed concurrently below. In some embodiments, the first mounting tabs 202 of the fan blade 190 include an upstream mounting tab 220 and a downstream mounting tab 222. In an installed configuration 224 of the fan blade 190 with the hub 46, the upstream mounting tab 220 may engage (e.g., abut) with the first mounting surface 96 (e.g., the upstream mounting surface of the hub 46), and the downstream mounting tab 222 may engage (e.g., abut) with the second mounting surface 110 (e.g., the downstream mounting surface of the hub 46) via a corresponding tab 102. That is, in the installed configuration 224 of the fan blade 190, the aperture 206 of the upstream mounting tab 220 may align with a corresponding first mounting aperture 112 in the first hub plate 90, and the aperture 206 in the downstream mounting tab 222 may align with a corresponding second mounting aperture 114 in the second hub plate 92. Fasteners 120 may extend through the corresponding apertures 112, 114, and/or 206 to couple the fan blade 190 to the first and second hub plates 90, 92. To this end, the upstream mounting tab 220 may be offset from the downstream mounting tab 222 by the offset dimension 128 (e.g., along the axial axis 80) to enable engagement of the first mounting tabs 202 with both the first mounting surface 96 and the second mounting surface 110 of the hub 46.

It should be appreciated that the apertures 112, 114, and 206 may also function as alignment features that facilitate coupling of the fan blade 190 to the hub 46. For example, the apertures 112, 114, and 206 may be respectively formed in the first hub plate 90, the second hub plate 92, and the fan blade 190 such that, upon alignment of the corresponding apertures 112, 114, and/or 206, the fan blade 190 is appropriately positioned (e.g., properly aligned) on the hub 46 (e.g., prior to coupling of the fan blade 190 to the hub 46 via the fasteners 120). For clarity, each of the remaining fan blades 48 may be coupled to the first mounting surface 96 of the first hub plate 90 and the second mounting surface 110 of the second hub plate 92 in accordance with the aforementioned techniques.

Figure 11:
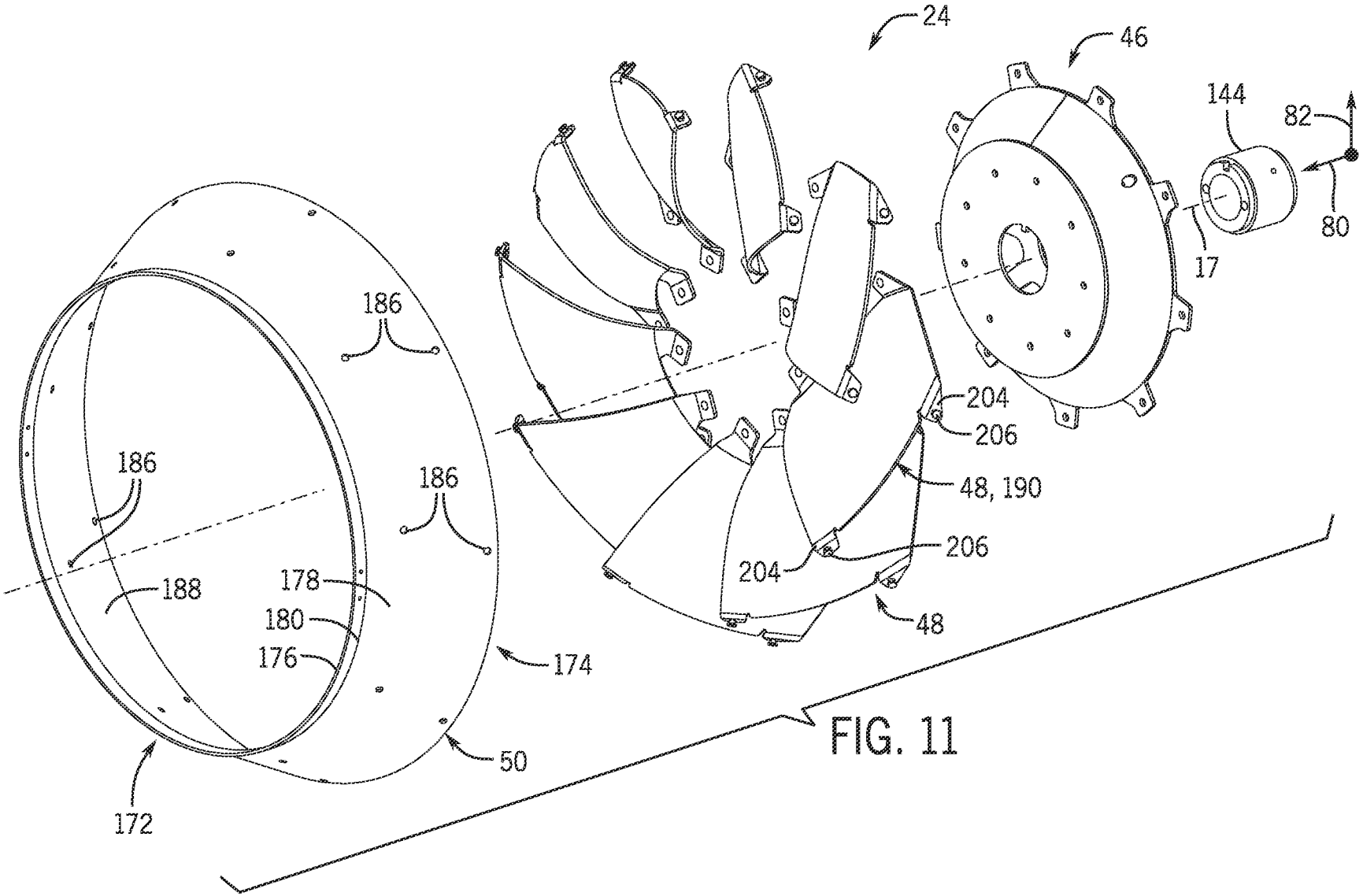
FIG. 11 is a partial exploded perspective view of an embodiment of a fan wheel of a mixed flow fan system, in accordance with an aspect of the present disclosure.
Figure 12:
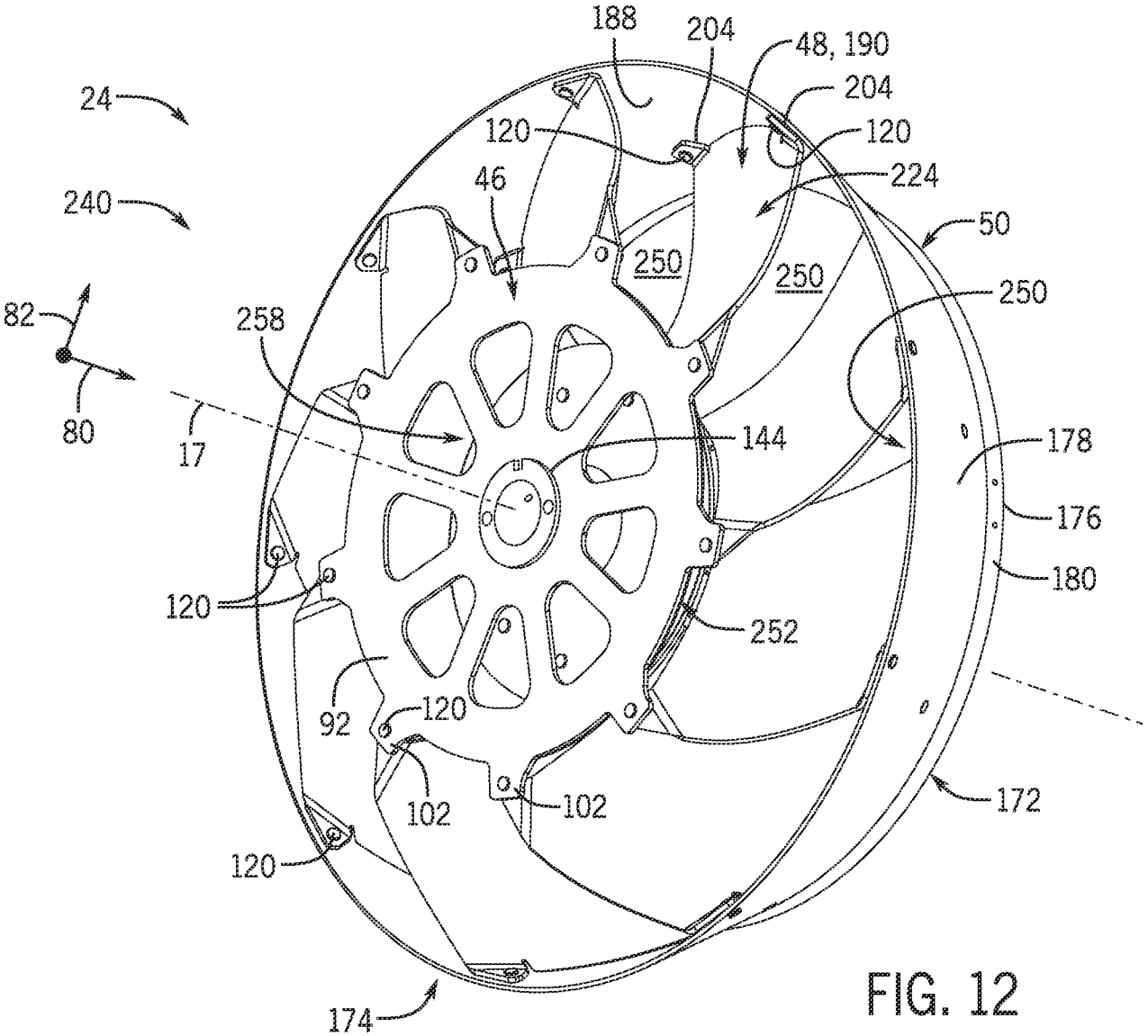
FIG. 12 is a rear perspective view of an embodiment of a fan wheel of a mixed flow fan system, in accordance with an aspect of the present disclosure.

FIG. 11 is a partial exploded perspective view of an embodiment of the fan wheel 24. FIG. 12 is a rear perspective view of an embodiment of the fan wheel 24 in an assembled configuration 240. FIGS. 11 and 12 are discussed concurrently below. In the illustrated embodiments of FIGS. 11 and 12, the fan blade 190 includes a pair of the second mounting tabs 204 that are configured to engage with (e.g., physically contact, abut) the inner surface 188 of the shroud 50 in the installed configuration 224 of the fan blade 190 with the shroud 50. In particular, in the installed configuration 224, the apertures 206 of the second mounting tabs 204 may align with corresponding third mounting apertures 186 of the shroud 50, such that suitable fasteners 120 may extend through the corresponding apertures 186, 206 to couple the fan blade 190 to the shroud 50. Alignment of the apertures 206 of the second mounting tabs 204 with corresponding apertures 186 of the shroud 50 may ensure proper alignment between the fan blade 190 and the shroud 50. For clarity, each of the remaining fan blades 48 may be coupled to the inner surface 188 of the shroud 50 in accordance with the aforementioned techniques.

It should be appreciated that, by mounting the fan blades 48 to the hub 46 and the shroud 50 in accordance with the present techniques, the fan wheel 24 may be assembled substantially without welding or utilization of another metallurgical process to couple the fan blades 48 to the hub 46 and to the shroud 50. That is, in some embodiments, the fan blades 48 may be secured to the hub 46 and the shroud 50 via the fasteners 120 without other securement techniques, for example. By enabling coupling of the fan blades 48 to the hub 46 and the shroud 50 via the fasteners 120, as opposed to utilizing a metallurgical process (e.g., welding), relative material thicknesses of the fan blades 48, the components of the hub 46, and/or the shroud 50 may be reduced.

Moreover, by enabling coupling of the fan blades 48 to the hub 46 and the shroud 50 via the fasteners 120, as opposed to utilizing a metallurgical process, the fan wheel 24 may be assembled from multiple different types of materials. As a result, an operational efficiency and/or operational performance of the fan wheel 24 may be improved, a structural rigidity of the fan wheel 24 may be increased, and/or manufacturing costs associated with producing the fan wheel 24 may be reduced. For example, in some embodiments, the hub 46 and the shroud 50 may be formed from a first type of material (e.g., a metallic material), and the fan blades 48 may each be formed from a second, different type of material (e.g., a polymeric material, carbon fiber, a different metallic material). In other embodiments, the hub 46, the fan blades 48, the shroud 50, or some combination thereof, may each be formed from different types of materials and may be coupled to form the fan wheel 24 in accordance with the presently disclosed techniques. As such, various characteristics of the fan wheel 24 may be more readily tailored to achieve particular structural properties, acoustic properties, and/or operational performance properties.

As shown in FIG. 12, the fan blades 48 may form a plurality of fluid passages 250 that extend between an outer surface 252 of the web 94 of the hub 46 and the inner surface 188 of the shroud 50. In some embodiments, in the assembled configuration 240 of the fan wheel 24, the outer surface 252 of the web 94 may extend generally parallel to the inner surface 188 of the second section 178 of the shroud 50. Therefore, a width of each of the fluid passages 250 extending between the outer surface 252 of the web 94 and the inner surface 188 of the second section 178 of the fan wheel 24 may be generally constant in certain embodiments. In other embodiments, a width of each of the fluid passages 250 between the outer surface 252 of the web 94 and the inner surface 188 of the second section 178 of the fan wheel 24 may be non-uniform.

In certain embodiments, the first hub plate 90, the web 94, and the second hub plate 92 may collectively define an interior volume 258 (e.g., a hollow interior region, a void) of the hub 46. Formation of the hub 46 to include the interior volume 258 may enable a reduction in an overall amount of material utilized to produce the hub 46. Inclusion of the interior volume 258 in the hub 46 may also reduce manufacturing costs associated with producing the hub 46, for example. Moreover, the interior volume 258 may reduce an overall weight of the hub 46 and, thus, reduce an overall rotational inertia (e.g., relative to the axial axis 80) of the fan wheel 24. In this way, the interior volume 258 may reduce an amount of power consumed by the motor 36 to adjust an operational speed of the fan wheel 24, for example, and thereby enhance an overall operational efficiency of the mixed flow fan system 10.

Figure 13:
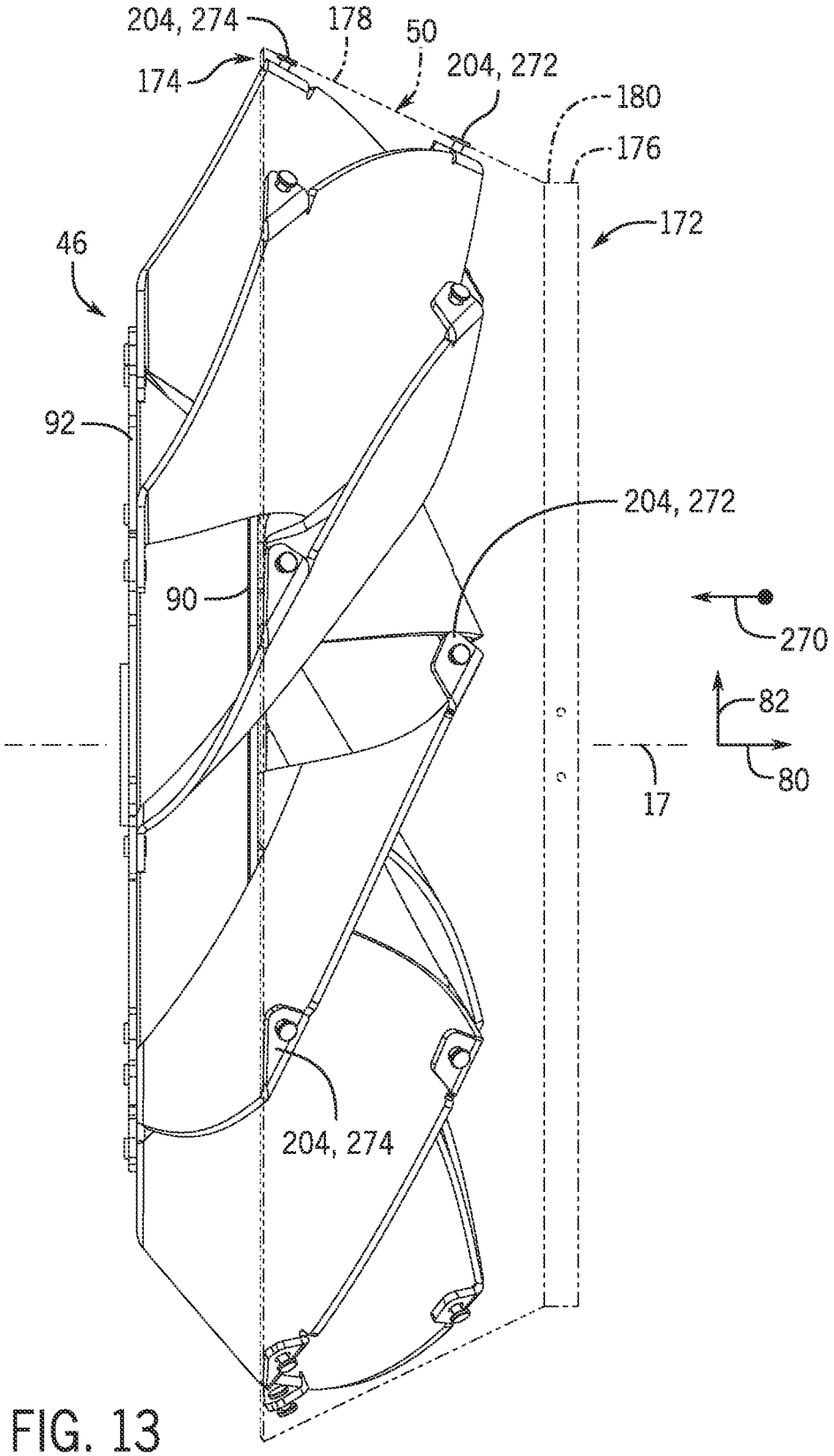
FIG. 13 is an elevation view of an embodiment of a fan wheel of a mixed flow fan system.

FIG. 13 is an elevation view of an embodiment of the fan wheel 24. In some embodiments, the upstream end portion 172 of the shroud 50 may define an upstream-most end of the fan wheel 24, with respect to a direction of air flow 270 across the fan wheel 24. The second hub plate 92 may be positioned downstream of the downstream end portion 174 of the shroud 50 with respect to the direction of air flow 270. In some embodiments, the first hub plate 90 may be positioned axially between (e.g., with respect to the axial axis 80) the second hub plate 92 and the downstream end portion 174 of the shroud 50. Moreover, as shown in the illustrated embodiment of FIG. 13, upstream mounting tabs 272 of the second mounting tabs 204 of the fan blades 48 may be positioned upstream of (e.g., with respect to the direction of air flow 270) and radially inward of (e.g., with respect to the axial axis 80) downstream mounting tabs 274 of the second mounting tabs 204 of the fan blades 48.

As set forth above, embodiments of the present disclosure may provide one or more technical effects useful for manufacture and assembly of a mixed flow fan wheel without or substantially without metallurgical bonding processes (e.g., welding). Accordingly, a material thickness of individual fan components utilized in the mixed flow fan wheel may be reduced. The assembled fan wheel may therefore have a reduced mass, as compared to typical mixed flow fan wheels, which may enable higher relative operational efficiencies of a mixed flow fan system utilizing the mixed flow fan wheel disclosed herein. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A fan wheel, comprising:

a hub, comprising:

a passage extending along an axis and configured to receive a shaft;

a first mounting surface positioned at a first location along the axis; and a second mounting surface axially offset from the first mounting surface relative to the axis and positioned at a second location along the axis; and a fan blade comprising a first mounting tab and a second mounting tab, wherein the first mounting tab is configured to engage with and couple to the first mounting surface and the second mounting tab is configured to engage with and couple to the second mounting surface.

2. The fan wheel of claim 1, comprising mechanical fasteners configured to secure the first mounting tab to the first mounting surface and to secure the second mounting tab to the second mounting surface.

3. The fan wheel of claim 2, wherein the mechanical fasteners comprise rivets, screws, bolts, spring pins, or a combination thereof.

4. The fan wheel of claim 1, wherein the first mounting surface and the second mounting surface extend substantially orthogonally to the axis and substantially parallel to one another.

5. The fan wheel of claim 4, comprising a web extending from the first mounting surface to the second mounting surface, wherein a radial dimension of the web, with respect to the axis, increases along a direction from the first mounting surface toward the second mounting surface.

6. The fan wheel of claim 1, comprising a shroud disposed about the hub, wherein the shroud comprises an inner surface extending in a direction from an upstream end portion of the shroud to a downstream end portion of the shroud, wherein a radial dimension of the inner surface, with respect to the axis, increases along the direction.

7. The fan wheel of claim 6, wherein the fan blade comprises a third mounting tab comprising a first aperture formed therein, the shroud comprises a second aperture extending through the inner surface, and the first aperture is configured to align with the second aperture to enable coupling of the fan blade to the shroud via a mechanical fastener.

8. The fan wheel of claim 1, wherein the hub comprises:

a collar defining the passage, wherein the collar comprises a slot; and a hub plate comprising the first mounting surface and a protrusion extending from the first mounting surface, wherein the protrusion is configured to engage with the slot to block rotational motion of the collar relative to the hub plate.

9. The fan wheel of claim 1, wherein the hub is formed from a first material, and the fan blade is made from a second material different than the first material.

10. A fan wheel, comprising:

a hub comprising a passage extending along an axis and configured to receive a shaft;

a shroud disposed about the hub and comprising an inner surface, wherein the inner surface extends from a first end portion of the shroud to a second end portion of the shroud, and wherein the inner surface comprises a diverging section that diverges radially from the axis along a direction extending from the first end portion toward the second end portion; and a fan blade comprising a body portion and a plurality of mounting tabs extending from the body portion, wherein the plurality of mounting tabs is coupled to the diverging section of the inner surface via mechanical fasteners.

11. The fan wheel of claim 10, wherein the mechanical fasteners comprise rivets, screws, bolts, spring pins, or a combination thereof.

12. The fan wheel of claim 10, wherein the hub comprises a first mounting surface positioned at a first location along the axis and a second mounting surface positioned at a second location along the axis, wherein the fan blade comprises an additional plurality of mounting tabs extending from the body portion, and wherein the additional plurality of mounting tabs is coupled to the first mounting surface and the second mounting surface via additional mechanical fasteners.

13. The fan wheel of claim 12, wherein the first mounting surface is axially offset from the second mounting surface along the axis and is substantially parallel to the second mounting surface.

14. The fan wheel of claim 10, wherein the hub comprises a first hub plate, a second hub plate axially offset from the first hub plate along the axis, and a web extending from the first hub plate to the second hub plate.

15. The fan wheel of claim 14, wherein a radial dimension of the web, with respect to the axis, increases along the direction from the first hub plate to the second hub plate.

16. The fan wheel of claim 14, wherein the first hub plate, the second hub plate, and the web define a hollow interior volume of the hub.

17. A fan wheel for a mixed flow fan system, comprising:

a hub configured to rotate about an axis of the mixed flow fan system, the hub comprising:

a first hub plate having a first mounting surface positioned at a first location along the axis; and a second hub plate offset from the first hub plate along the axis and having a second mounting surface positioned at a second location along the axis; and a fan blade comprising a first mounting tab and a second mounting tab, wherein the first mounting tab is mounted to the first mounting surface, and the second mounting tab is mounted to the second mounting surface.

18. The fan wheel of claim 17, comprising a shroud disposed about the hub, wherein the fan blade comprises a third mounting tab, and wherein the third mounting tab is mounted to an inner surface of the shroud.

19. The fan wheel of claim 18, wherein the first mounting tab is mounted to the first mounting surface via a first mechanical fastener, the second mounting tab is mounted to the second mounting surface via a second mechanical fastener, and the third mounting tab is mounted to the inner surface via a third mechanical fastener.

20. The fan wheel of claim 18, wherein the first hub plate is positioned axially between, with respect to the axis, the second hub plate and an upstream end portion of the shroud.

* * * * *